US008464616B2

(12) United States Patent
Chang

(10) Patent No.: US 8,464,616 B2
(45) Date of Patent: Jun. 18, 2013

(54) TOOLS WITH DRIVING RODS

(76) Inventor: Man-Chi Chang, Taichung (TW)

( * ) Notice: Subject to any disclaimer, the term of this patent is extended or adjusted under 35 U.S.C. 154(b) by 127 days.

(21) Appl. No.: 13/244,637

(22) Filed: Sep. 25, 2011

(65) Prior Publication Data

US 2013/0074661 A1 Mar. 28, 2013

(51) Int. Cl.

| | |
|---|---|
| ***B25B 23/16*** | (2006.01) |
| ***B25B 13/46*** | (2006.01) |
| ***B25G 1/00*** | (2006.01) |
| ***B25G 1/04*** | (2006.01) |

(52) U.S. Cl.

USPC ..... 81/177.9; 81/177.8; 81/177.85; 81/177.2; 81/177.7; 81/60; 81/61; 81/62; 81/63

(58) Field of Classification Search

USPC ..... 81/177.8, 177.85, 177.9, 177.2, 177.7, 81/60–63

See application file for complete search history.

(56) References Cited

U.S. PATENT DOCUMENTS

| | | | | |
|---|---|---|---|---|
| 5,943,925 | A * | 8/1999 | Huang | 81/177.2 |
| 6,382,058 | B1 * | 5/2002 | Owoc | 81/177.9 |
| 6,729,209 | B1 * | 5/2004 | Chen | 81/63 |
| 7,398,711 | B1 * | 7/2008 | Liu | 81/177.2 |
| 2005/0268753 | A1 * | 12/2005 | Lin | 81/177.9 |
| 2007/0283790 | A1 * | 12/2007 | Cheng | 81/177.9 |
| 2008/0066587 | A1 * | 3/2008 | Domanico et al. | 81/177.7 |

* cited by examiner

*Primary Examiner* — Monica Carter
*Assistant Examiner* — Danny Hong

(57) ABSTRACT

A tool includes first, second and third rods which are pivotably and pivotably connected to each other. The first rod is pivotably connected between the second and third rods. Control members, resilient members and contacting members are located at the pivotal portions so as to control the first rod to be pivotable or positioned relative to the second and third rods.

7 Claims, 8 Drawing Sheets

TOOLS WITH DRIVING RODS

FIELD OF THE INVENTION

The present invention relates to a tool, and more particularly, to a tool with multiple driving rods which are pivotably and can be adjusted to a fixed position.

BACKGROUND OF THE INVENTION

A conventional tool with driving rods is disclosed in U.S. Pat. No. 6,443,039 and generally includes a first driving stem and a second driving stem which is pivotably connected to the first driving stem by a pin. The advantage of the tool is that the first and second driving stems can be pivoted relative to each other. Nevertheless, the first driving stem cannot be fixed relative to the second driving stem so that when using the tool, the two driving stems are in unstable status.

The present invention intends to provide a tool with multiple driving rods which can be fixed to each other to increase the efficiency thereof.

SUMMARY OF THE INVENTION

The present invention relates to a tool includes a first rod, a second rod, a third rod, control members, resilient members and contacting members. The first rod is pivotably connected between the second and third rods. A first transverse hole is defined in the mediate portion of the first rod. The first pivotal portion has a first pivotal hole and multiple first recesses. The second pivotal portion has two first lugs and a second pivotal hole. A circular hole is defined in the bottom of the second pivotal portion and communicates with the first transverse hole. A first engaging portion and a third pivotal portion are respectively connected to the two ends of the second rod. A second transverse hole is defined in the mediate portion of the second rod. The third pivotal portion is pivotably connected to the first pivotal portion. The third pivotal portion has two second lugs and two third pivotal holes respectively defined through the two second lugs. The third pivotal portion has a second circular hole which communicates with the second transverse hole. A second engaging portion and a fourth pivotal portion are respectively connected to the two ends of the third rod. The fourth pivotal portion is pivotably connected to the second pivotal portion and has a fourth pivotal hole and multiple second recesses. The two control members are respectively and movably located in the first and second transverse holes. Each of the two control members has a notch which has a shallow portion and deep portion. The two resilient members are respectively located in the first and second transverse holes. Two contacting members are respectively located in the first and second circular holes and respectively engaged with the notches. One of two pins extends through the first and third pivotal holes to pivotably connect the first rod with the second rod, and the other one of the two pins extends through the second and fourth pivotal holes to pivotably connect the first rod with the third rod.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
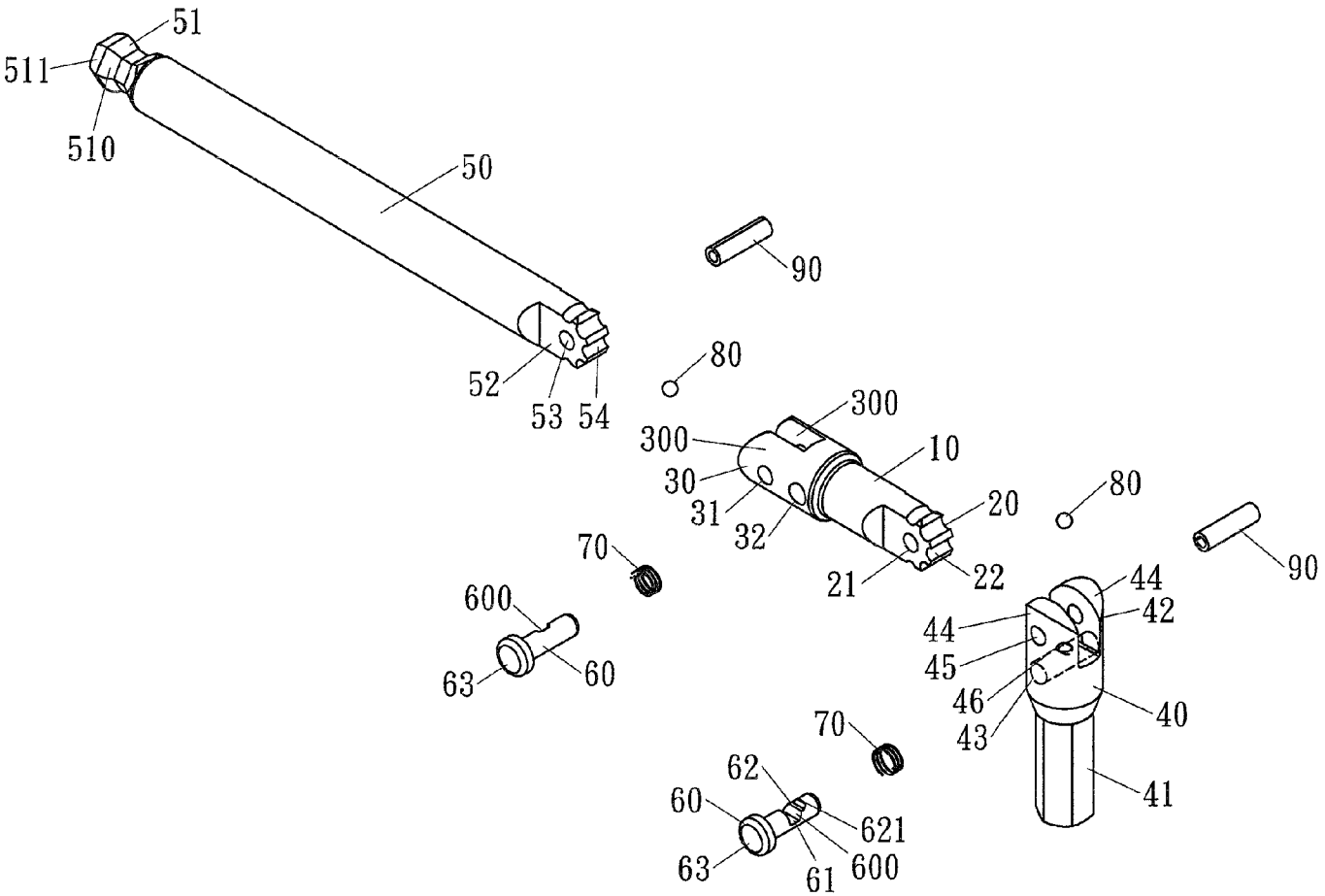
FIG. 1 is an exploded view to show the tool of the present invention.

Referring to FIG. 1, the tool of the present invention comprises a first rod 10 which has two ends, and a first pivotal portion 20 and a second pivotal portion 30 are respectively connected to the two ends of the first rod 10. A first transverse hole 32 is defined through the mediate portion of the first rod 10. The first pivotal portion 20 has a first pivotal hole 21 defined transversely therein and multiple first recesses 22 are located around the first pivotal hole 21. The second pivotal portion 30 has two first lugs 300 and two second pivotal holes 31 are respectively defined through the two first lugs 300. The first transverse hole 32 is parallel to the second pivotal hole 31 and located at a distance from the second pivotal hole 31. The second pivotal portion 30 has a first circular hole 33 which communicates with the first transverse hole 32.

A second rod 40 has two ends, a first engaging portion 41 and a third pivotal portion 42 respectively connected to the two ends of the second rod 40. A second transverse hole 43 is defined in the mediate portion of the second rod 40. The third pivotal portion 42 is pivotably connected to the first pivotal portion 20. The third pivotal portion 42 has two second lugs 44 and two third pivotal holes 45 are respectively defined through the two second lugs 44. The second transverse hole 43 is parallel to the third pivotal hole 45 and located at a distance from the third pivotal hole 45. The third pivotal portion 42 has a second circular hole 46 which communicates with the second transverse hole 43.

A third rod 50 has two ends, a second engaging portion 51 and a fourth pivotal portion 52 are respectively connected to the two ends of the third rod 50. The fourth pivotal portion 52 is pivotably connected to the second pivotal portion 30 and has a fourth pivotal hole 53 defined transversely therein. Multiple second recesses 54 are located around the fourth pivotal hole 53.

Two control members 60 are respectively and movably located in the first and second transverse holes 32, 43. Each of the two control members 60 has an enlarged head 63 and a notch 600 is defined in a periphery of each of the control members 60. The notch 600 has a shallow portion 62 and deep portion 61. When the two control members 60 are located at a first position, the shallow portion 62 of the notch 600 is located to face the first and second circular holes 33, 46. When the two control members 60 are located at a second position, the deep portion 61 of the notch 600 is located to face the first and second circular holes 33, 46.

Two resilient members 70 are respectively located in the first and second transverse holes 32, 43 so as to respectively provide return forces to the two control members 60.

Two contacting members 80 are respectively located in the first and second circular holes 33, 46 and respectively engaged with the notches 600 of the two control members 60. When the two control members 60 are respectively located at a first position, the two contacting members 80 are respectively merged in the first and second circular holes 33, 46 and disengaged from the first and second recesses 22, 54. When the two control members 60 are respectively located at a second position, the two contacting members 80 respectively protrude from the first and second circular holes 33, 46 and are engaged with the first and second recesses 22, 54.

There are two pins 90, one of two pins 90 extends through the first and third pivotal holes 21, 45 to pivotably connect the first rod 10 with the second rod 40. The other one of the two pins 90 extends through the second and fourth pivotal holes 31, 53 to pivotably connect the first rod 10 with the third rod 50.

Figure 2:
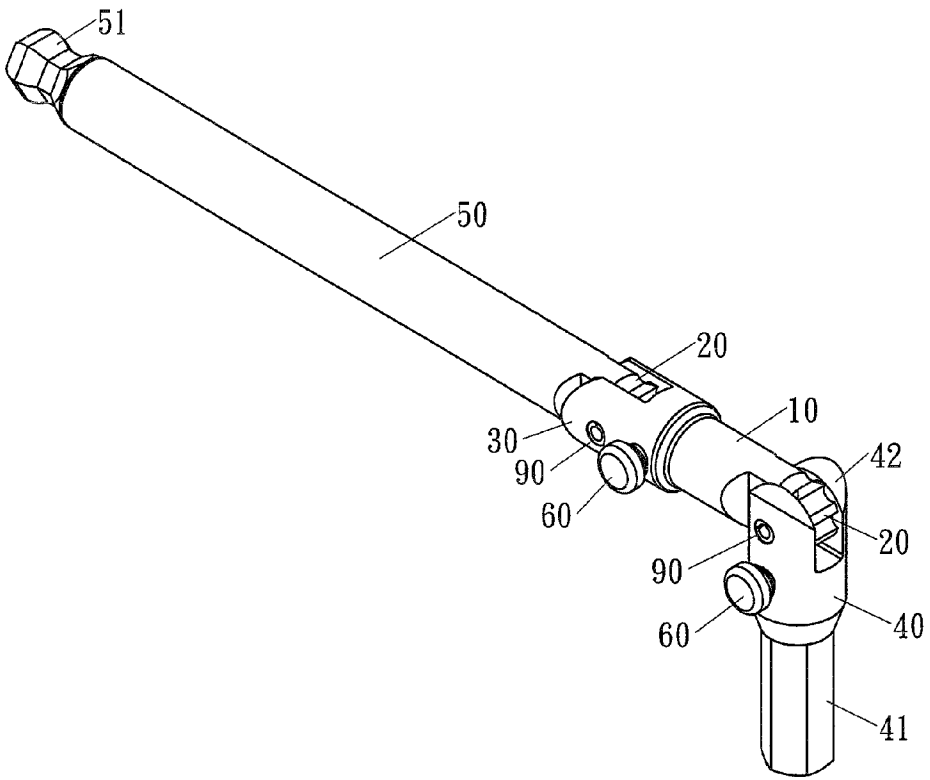
FIG. 2 is a perspective view to show the tool of the present invention.
Figure 3:
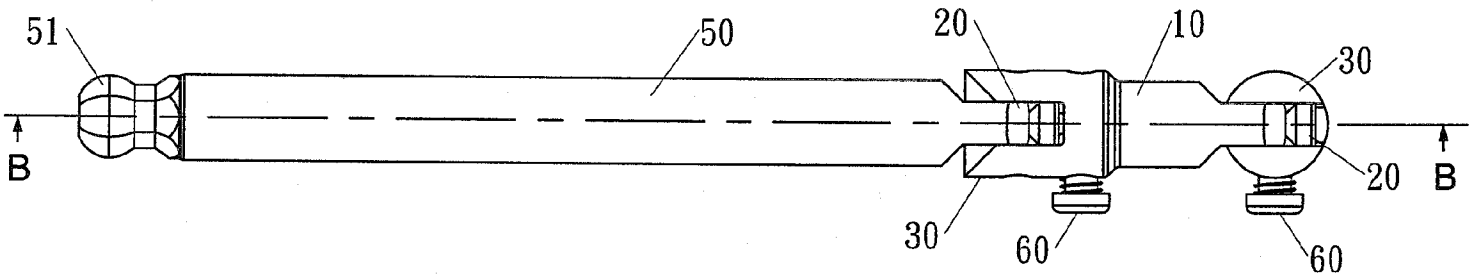
FIG. 3 is a top view of the tool of the present invention.
Figure 4:
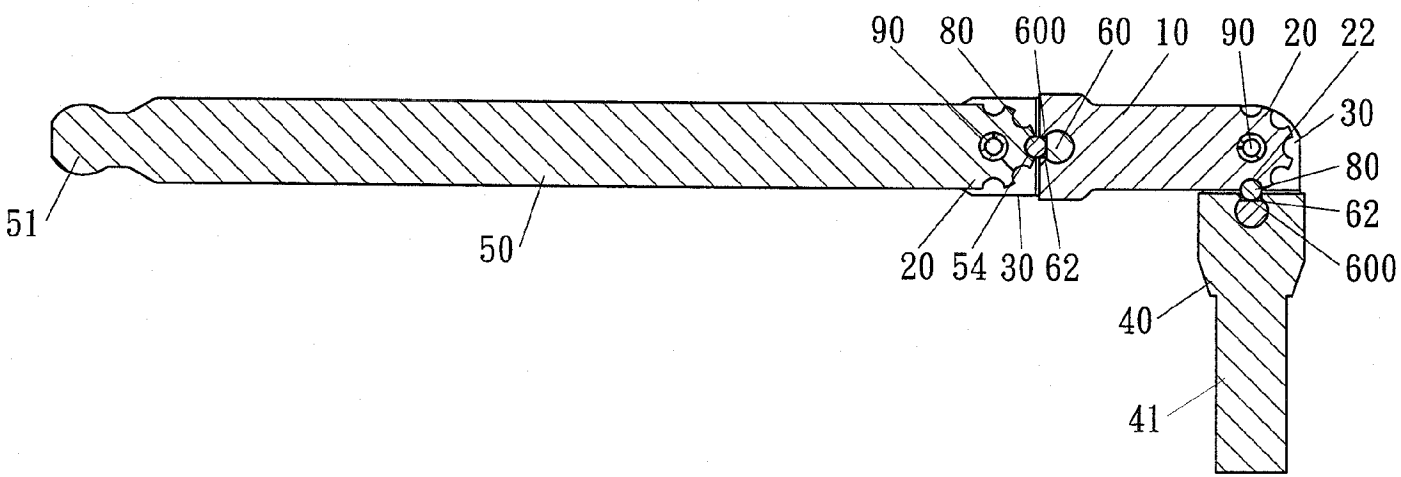
FIG. 4 is a cross sectional view, taken along line B-B in FIG. 3.
Figure 5:
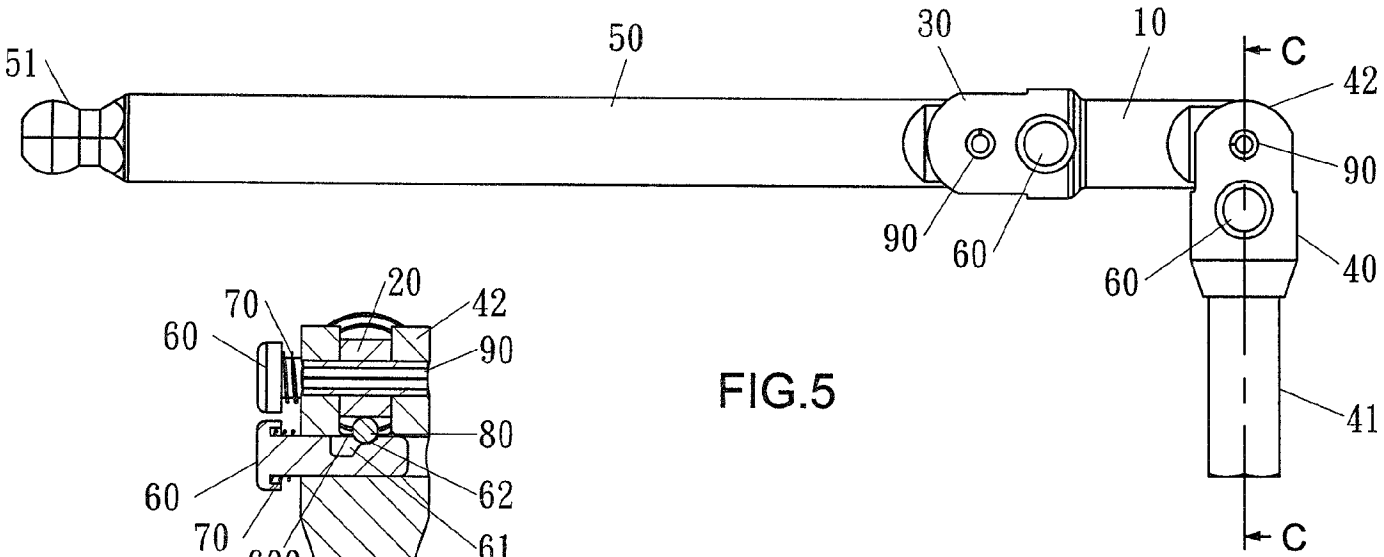
FIG. 5 is a side view of the tool of the present invention.

As shown in FIGS. 1 and 2, the second rod 40 is a cylindrical member and the first engaging portion 41 is a cylindrical member with a hexagonal cross section. The second engaging portion 51 of the third rod 50 can be connected with an object and comprises two sections which are connected to each other. Two respective peripheries of the two sections form two symmetrical hexagonal cone shaped bodies 510, 511. The third rod 50 is longer than the second rod 40.

As shown in FIGS. 2 to 6, two control members 60 are respectively and movably located in the first and second transverse holes 32, 43. The resilient members 70 are mounted to the two control members 60. The two contacting members 80 are respectively located in the first and second circular holes 33, 46.

The contacting member 80 is partially engaged with the shallow portion 62 of the notch 600 and the first or second recess 22 or 54 so that the first rod 10 is positioned at a fixed angle relative to the second rod 40, and the first rod 10 is positioned at a fixed angle relative to the third rod 50.

Figure 7:
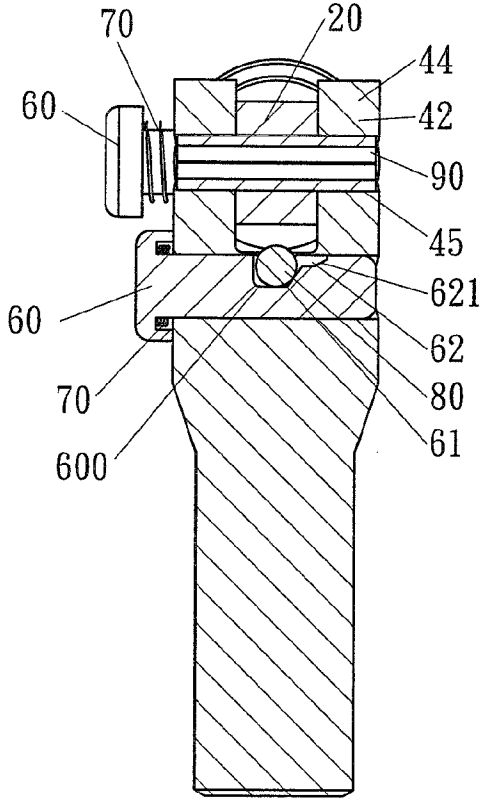
FIG. 7 shows that the control member is pushed and the contacting member is merged in the notch.

As shown in FIG. 7, when the user presses the control member 60, the resilient member 70 is compressed so that the control member 60 moves to the second position. The deep portion 61 of the notch 600 is located to face the circular hole 33. The contacting member 80 is merged in the circular hole 33 and is disengaged from the first/second recess 22/54. The second rod 40 and the third rod 50 are pivotable relative to the first rod 10. When a desired angle is set, the control member 60 is released, the resilient member 70 pushes the control member 60 to its original position, the shallow portion 62 of the notch 600 is located to face the circular hole 33, such that the contacting member 80 is engaged with the first recess 22, and the second and third rods 40, 50 are fixed relative to the first rod 10.

Figure 8:
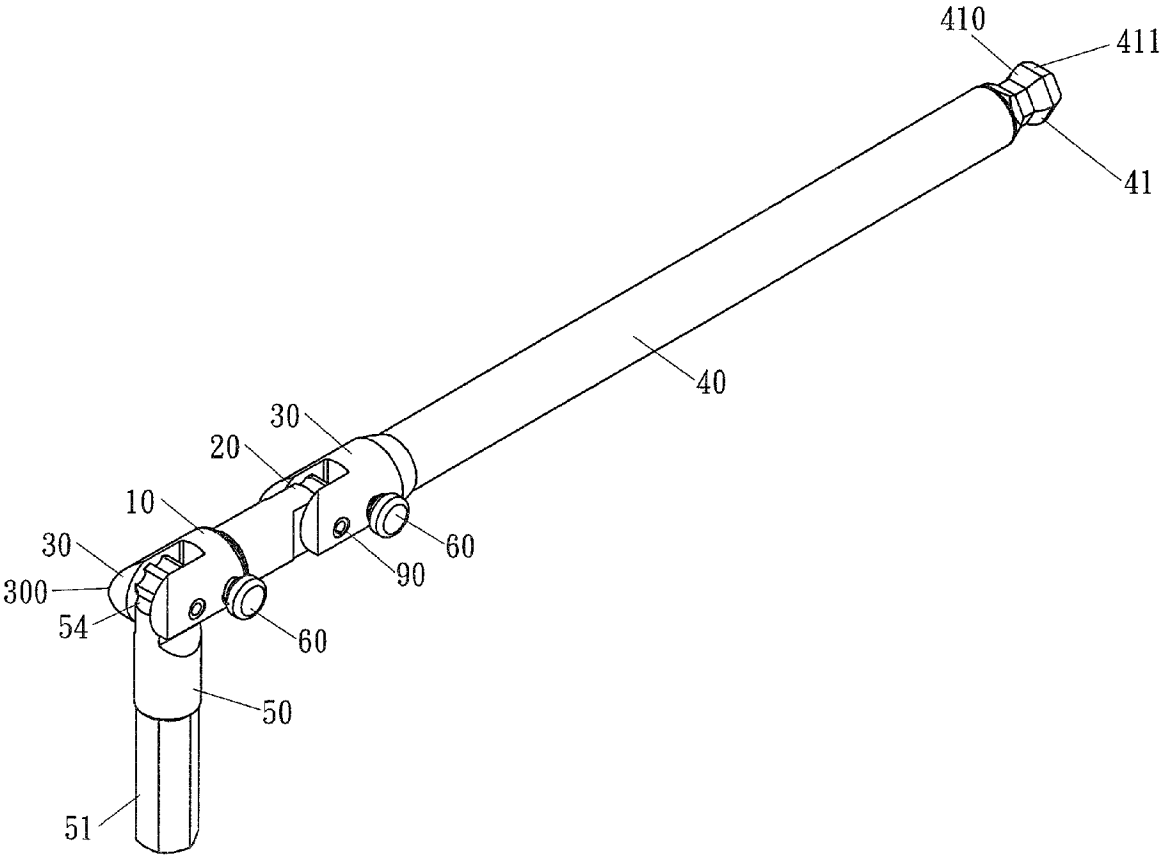
FIG. 8 shows another embodiment of the first and second rods of the tool of the present invention.

As shown in FIG. 8, the third rod 50 is shorter than the second rod 40, and the engaging shape of the second engaging portion 51 is a hexagonal rod. The first engaging portion 41 of the second rod 40 includes two connected sections which have two respective peripheries which form two symmetrical hexagonal cone shaped bodies 410, 411.

Figure 9:
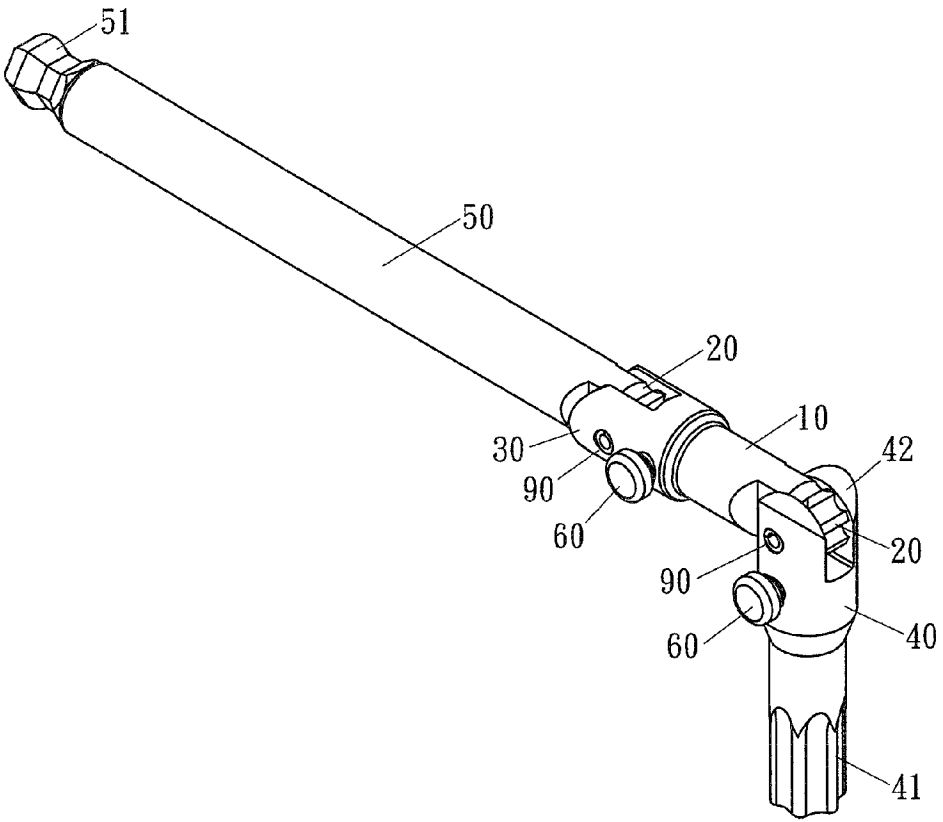
FIG. 9 shows another embodiment of the first engaging portion of the tool of the present invention.
Figure 10:
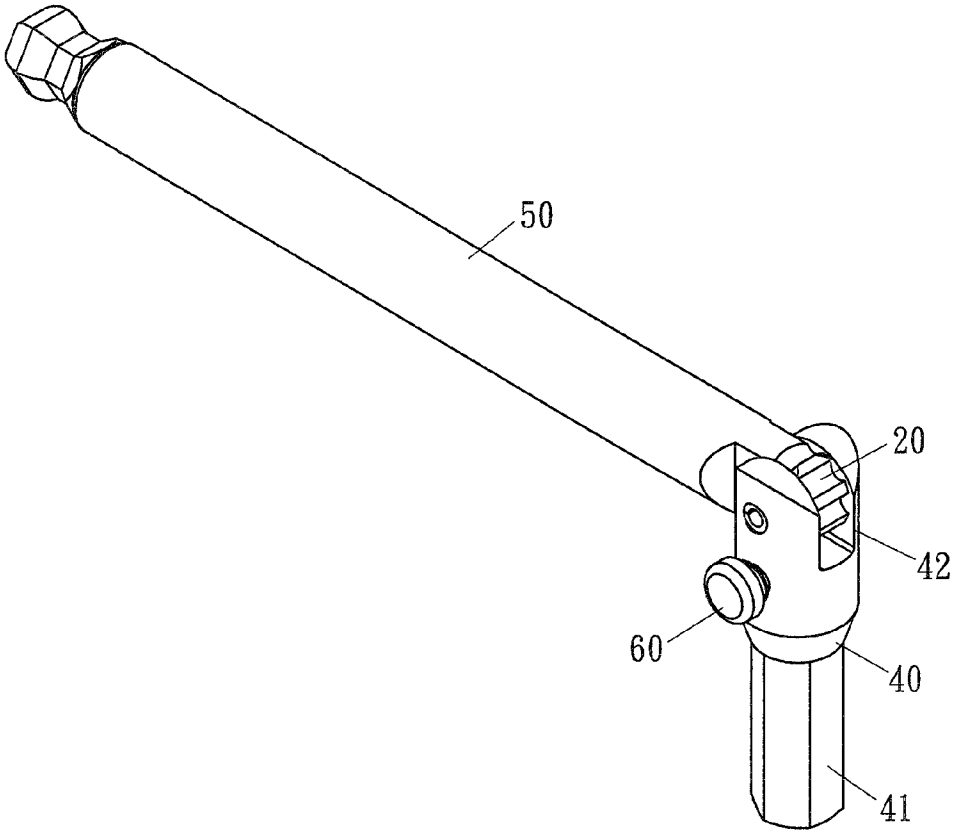
FIG. 10 shows that the second and third rods are connected to each other.

FIG. 9 shows another shape of the first engaging portion 41 of the first rod 10 and FIG. 10 shows that the second and third rods 40, 50 can be directly pivotably connected to each other to form two-section portion.

As shown in FIGS. 2 and 10, the third pivotal portion 42 of the second rod 40 is the same as the second pivotal portion 30 so that the third and fourth pivotal portions 30, 40 can be pivotably connected to each other. The tool can be used as two-section or three-section tool.

The second and third rods 40, 50 can be pivotable or fixed relative to the first rod 10 so that the tool can be operated more reliable.

The multiple-section design of the tool can be used for different situations and tasks.

The structure of the tool is simple and can be assembled within short period of time.

Figure 6:
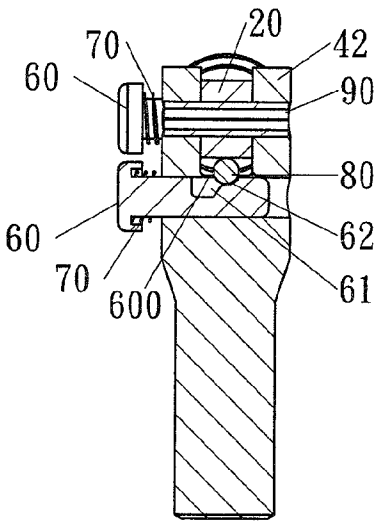
FIG. 6 is a cross sectional view, taken along line C-C in FIG. 5.

As shown in FIG. 6, the shallow portion 62 of the notch 600 includes an inclined and upward ramp 621 to guide the contacting member 80. When the first transverse hole 32 is not located at desired position, the contacting member 80 is pushed by the ramp 621 and the resilient member 70 to be engaged with the first recess 22. The first transverse hole 32 of the second pivotal portion 30 has larger tolerance which is benefit when machining.

While we have shown and described the embodiment in accordance with the present invention, it should be clear to those skilled in the art that further embodiments may be made without departing from the scope of the present invention.

What is claimed is:

1. A tool comprising:

a first rod having two ends, a first pivotal portion and a second pivotal portion respectively connected to the two ends of the first rod, a first transverse hole defined through a mediate portion of the first rod, the first pivotal portion having a first pivotal hole defined transversely therein, multiple first recesses located around the first pivotal hole;

the second pivotal portion having two first lugs and two second pivotal holes respectively defined through the two first lugs, the first transverse hole being parallel to the second pivotal hole and located at a distance from the second pivotal hole, the second pivotal portion having a first circular hole which communicates with the first transverse hole;

a second rod having two ends, a first engaging portion and a third pivotal portion respectively connected to the two ends of the second rod, a second transverse hole defined in a mediate portion of the second rod, the third pivotal portion pivotably connected to the first pivotal portion, the third pivotal portion having two second lugs and two third pivotal holes respectively defined through the two second lugs, the second transverse hole being parallel to the third pivotal hole and located at a distance from the third pivotal hole, the third pivotal portion having a second circular hole which communicates with the second transverse hole;

a third rod having two ends, a second engaging portion and a fourth pivotal portion respectively connected to the two ends of the third rod, the fourth pivotal portion pivotably connected to the second pivotal portion and having a fourth pivotal hole defined transversely therein, multiple second recesses located around the fourth pivotal hole;

two control members respectively and movably located in the first and second transverse holes, each of the two control members having an enlarged head and a notch defined in a periphery of each of the control members, the notch having a shallow portion and deep portion, when the two control members located at a first position, the shallow portion of the notch is located to face the first and second circular holes, when the two control members located at a second position, the deep portion of the notch is located to face the first and second circular holes;

two resilient members respectively located in the first and second transverse holes so as to respectively provide return forces to the two control members;

two contacting members respectively located in the first and second circular holes and respectively engaged with the notches of the two control members, when the two control members are respectively located at a first position, the two contacting members are respectively merged in the first and second circular holes and disengaged from the first and second recesses, when the two control members are respectively located at a second position, the two contacting members respectively protrude from the first and second circular holes and are engaged with the first and second recesses, and one of two pins extending through the first and third pivotal holes to pivotably connect the first rod with the second rod, the other one of the two pins extending through the second and fourth pivotal holes to pivotably connect the first rod with the third rod.

2. The tool as claimed in claim 1, wherein the first engaging portion is a cylindrical member with a hexagonal cross section.

3. The tool as claimed in claim 1, wherein the second engaging portion comprises two sections which are connected to each other, two respective peripheries of the two sections form two symmetrical hexagonal cone shaped bodies.

4. The tool as claimed in claim 1, wherein the third rod is longer than the second rod.

5. The tool as claimed in claim 1, wherein an engaging shape of the second engaging portion is different from that of the first engaging portion.

6. The tool as claimed in claim 1, wherein each of the contacting members is a ball.

7. The tool as claimed in claim 1, wherein the third pivotal portion of the second rod is the same as that of the second pivotal portion, so that the third pivotal portions is pivotably connected to the fourth pivotal portion.

* * * * *